United States Patent [19]

Del Monte

[11] 4,291,882

[45] Sep. 29, 1981

[54] BINGO CARD HOLDER

[76] Inventor: Samie J. Del Monte, 84 Sunset St., Buffalo, N.Y. 14207

[21] Appl. No.: 180,837

[22] Filed: Aug. 25, 1980

[51] Int. Cl.[3] ..... A63F 9/00

[52] U.S. Cl. ..... 273/148 A; 40/124; 40/124.4; 40/10 R; 40/606

[58] Field of Search ..... 40/10 R, 11 R, 124, 40/124.4, 606; 273/148 R, 148 A, 150 R, 269

[56] References Cited

U.S. PATENT DOCUMENTS

| | | | |
|---|---|---|---|
| 905,578 | 12/1908 | Read | 40/124.4 |
| 1,404,599 | 1/1922 | Glenny | 273/150 |
| 1,511,731 | 10/1924 | Kimmel | 273/269 |
| 2,785,901 | 3/1957 | McLemore | 273/150 |
| 2,818,261 | 12/1957 | Morgan | 273/150 |
| 3,948,525 | 4/1976 | Faintuch | 273/150 |
| 3,984,107 | 10/1976 | Nelson | 273/148 A |
| 4,006,905 | 2/1977 | Marbury | 273/148 A |
| 4,138,119 | 2/1979 | Brannon | 273/148 A |

*Primary Examiner*—Gene Mancene
*Assistant Examiner*—Wenceslao J. Contreras
*Attorney, Agent, or Firm*—Raymond F. Kramer

[57] ABSTRACT

A bingo card holder, for supporting a plurality of bingo cards to be played simultaneously by a single player, includes at least a pair of holding means, such as longitudinal slots, each of which is capable of supporting at least one bingo card, with such cards being holdable so that one is substantially horizontal, preferably inclined downwardly and forwardly toward a player, and the other is substantially vertical, preferably inclined upwardly and away from the player. The holders are usually molded of a synthetic organic polymeric thermoplastic material, are adaptable to be joined together, may be nested for storage, may include recess means for holding bingo playing materials and incidentals, and preferably include projections in the walls of the slots for better holding the cards.

12 Claims, 2 Drawing Figures

BINGO CARD HOLDER

This invention relates to a holder for bingo cards. More particularly, it relates to such a holder for displaying a plurality of such cards in desirable playing positions, so that one playing the game may easily and conveniently cover the various called numbers on a plurality of cards.

The game of bingo is played by millions each week in the United States and has become an important source of revenue for religious and charitable institutions. Whereas originally each player played one card, attempting to cover five spaces in a row to win, today most players play a plurality of cards simultaneously in an effort to improve their odds of winning. Various devices have been made to hold such pluralities of cards and various auxiliary features have been incorporated in them.

In a search made shortly before the filing of this application the art found relevant to the present invention included U.S. Pat. Nos. 1,509,773; 2,624,582; 2,742,292; 2,784,973; 3,323,801; and 3,810,323. Of these patents, U.S. Pat. Nos. 2,784,973 and 3,810,323 relate specifically to bingo card holders and the other patents are for various card holders and game devices.

U.S. Pat. No. 2,784,973 shows a foldable apparatus adapted to hang over a table edge and to provide support for a plurality of bingo boards and the markers used for playing the game. U.S. Pat. No. 3,810,323 illustrates a convertible bingo card holder, capable of holding as many as eight bingo cards for viewing and playing, which is foldable to compact form. U.S. Pat. No. 3,323,801 illustrates a foldable card holder and U.S. Pat. No. 2,742,292 shows a polystyrene playing card holder having a plurality of vertical slots. U.S. Pat. Nos. 1,509,773 and 2,624,582 show different types of game devices, including card holders, which are joinable together. In U.S. Pat. No. 1,509,773 such joinder is shown as being effected by dovetailing means.

Although bingo card and playing card holders are known, none of the prior art of which applicant is aware shows any holders like those of the present invention, in which bingo cards are conveniently displayed in substantially vertical and substantially horizontal positions, inclined so as to promote better viewing and playing thereof. Also, none of the prior art references known to applicant, either alone or in combination, makes obvious the subject matter of this invention, including the convenient joinder together of a plurality of such holders to stabilize them and facilitate playing of a multiplicity of cards, the improvement of the strength of the holder, which can be of thin material, by utilizing a formed in recess for holding game elements and incidentals, the inclusion of projecting means in the holding slots for better yieldingly holding the bingo cards in place, and the utilization of a balanced holding structure which tends to stabilize the relatively light weight holders.

In accordance with the present invention a holder for a plurality of bingo cards to be played simultaneously by a single player comprises a body having at least a pair of holding means, each of which is capable of supporting a bingo card, with such cards being holdable so that one is substantially horizontal and another is substantially vertical. Desirably, the holder includes means at the ends thereof, such as molded-in dovetail joints, for fastening a plurality of holders together and the card holding means are slots which may include internal projections for better holding the bingo cards in place. Also, the holder preferably includes a strengthening walled recess portion and slots of particular inclinations, and is blow molded or otherwise suitably formed, in at least a partially nesting configuration, to improve storage in a minimum of space.

The invention will be readily understood by reference to the description thereof in this specification, taken in conjunction with the accompanying drawing in which.

Figure 1:
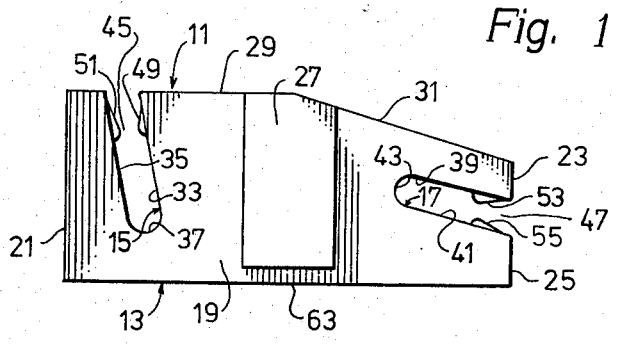
FIG. 1 is a side elevational view of a holder of this invention.

In FIG. 1 numeral 11 designates the invented holder for a plurality of bingo cards, comprising a body portion 13 and a plurality of walled holding means 15 and 17 therein. As shown, the holder is formed of a thermoplastic polymeric material, such as polystyrene, polypropylene, polyethylene, PVC, nylon or other suitable "plastic", preferably made by a blow molding technique, although other molding methods may also be employed. Preferably, the holder is also comparatively thin walled, so as to make the product light in weight and of low cost. Body 13 includes vertical sides, one of which, identified by numeral 19, is shown, and vertical back, upper front and lower front walls, 21, 23 and 25, respectively, but such walls may be inclined and, to facilitate nesting storage, such inclinings may be preferred. A dovetail wall portion 27, to facilitate joinder together of a plurality of holders, is also shown in FIG. 1. The rear top portion of the holder, the surface of which is identified by numeral 29, is horizontal and the front top surface 31 is flat (except for a recessed portion and a dovetail opening, which will be described with respect to FIG. 2), and is inclined downwardly toward the user of the holder and the player of bingo.

Holder 11 includes at least a pair of holding means, 15 and 17, each of which is capable of supporting a bingo card. The cards are holdable in position so that one is held substantially horizontally, preferably inclined downwardly and toward the player, and the other is held substantially vertically, preferably inclined upwardly and away from the player, which positions facilitate clear, space conserving viewings of the cards and playing of the game. The holding means 15 and 17 include, respectively, front and back walls 33 and 35, with curved bottom supporting portion 37, and top and bottom walls 39 and 41, with connecting wall portion 43. Slots 45 and 47, defined respectively by walls 33, 35 and 37 for slot 45, and 39, 41 and 43 for slot 47, have projections 49, 51, 53 and 55 extending into them, respectively, so as to narrow down the clearances between the bingo cards and the slot walls and to press against the cards or pinch them, thereby better holding them in position. The slots have been enlarged for purpose of illustration but in actuality they will usually be of approximately the design thickness of the card, with the projections from the slot walls resiliently pressing against the card and squeezing it so that it is held in position, but may be removed when desired. It is noted that the projections are rounded and are angled so as to facilitate insertion, making removal somewhat more difficult. Also, as illustrated, the projections are directly opposed to each other but they may be staggered, if so desired. Of course, different numbers and types of projections may be utilized. It will be noted that the slots, while respectively substantially vertical and substantially horizontal, are illustrated in the present preferred form of the invention as being inclined to the vertical and the horizontal, respectively. Thus, substantially vertical slot 45 is at an angle of 0° to 45°, preferably 5° to 25° or 30° from the vertical, and slot 47 is at an angle of 5° to 30°, preferably from 5° to 15° or 20° from the horizontal. Such angles have been preferred for best holding, viewing and balancing of the cards and for best strengthening the holder.

Figure 2:
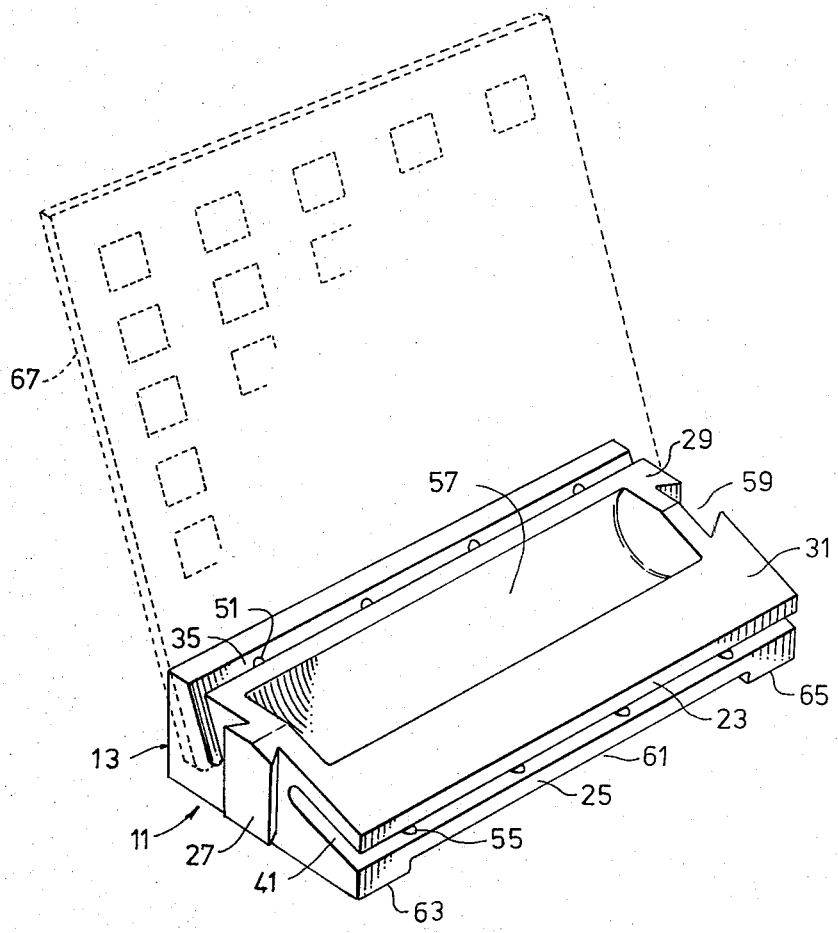
FIG. 2 is a front-side perspective view of the holder of FIG. 1, showing the positioning of a typical bingo card in a substantially vertical card holding slot of the holder.

In FIG. 2, in addition to the various parts already referred to with respect to FIG. 1, which are similarly numbered in many instances, there are illustrated longitudinally extending curved hollow or recess 57 and dovetail shaped opening 59, as well as lower recess 61, which helps to define supporting legs 63 and 65. Also, in phantom, illustrated in position in the holder, there is shown a typical bingo card 67, which may be of any suitable style. Recess 57 is useful for holding game playing material such as game pieces, marking implements, daubers and incidentals, including change and cosmetics. Of course, dovetail opening 59 is adapted to fit a dovetail projection of another holder, like that indicated by numeral 27, so as to join together in a row a plurality of holders of the present invention. Such joinder helps to rigidify the assembly and assists in stabilizing it. Furthermore, although in the present illustrations the bingo card is shown as being slightly larger than the holder, the present holders are adapted to be utilized with various sizes of cards. When the holders are assembled together, with the slots therein aligned so that the cards may be placed close together and portions of the cards may extend across different holders, such will further help to stabilize the assembly. It will be noted that the various indentations and curved and interfitting wall portions of the invented articles help to strengthen them. This is especially useful when they are made of relatively thin plastic materials, usually being from 0.5 to 4 mm. thick, frequently from 1 to 3 mm. thick, e.g., about 1.5 or 2 mm. thick, or averaging such dimensions. Similarly, the strengthened article structure thereby better holds the various shapes of the wall portions thereof in position.

Although it is highly preferable that relatively thin thermoplastic material be employed it is within the present invention to utilize different thicknesses and other materials of construction, e.g., metals, and to stamp the various parts from sheet stock. Also, while joinder together by means of dovetail-type joints is highly preferred and joinder in longitudinal relationship has special advantages, other means of joinder may be employed and non-longitudinal assemblies may be made. Furthermore, instead of the invented articles being made entirely of one substance, different parts may be made of different materials. For example, rubber feet may be utilized in place of or in addition to the described leg or support portions.

As shown in the illustration, the present holders are adaptable for use with: bingo cards that are to be marked with a crayon or a felt-tip pen; cards that are to have game elements, such as corn kernels, beans or markers placed on the called numbers; and cards wherein a slide is utilized to cover or otherwise identify a called number (or free space). Of course, the "vertical" card would not normally support loose markers so if the vertical slot is to be utilized in a bingo game played with loose markers the card will be adapted by being bent or by being rested or mounted on an adapter for the present device, not shown, which will fit in the vertical slot and will support a second "horizontal" card in desired position. Of course, when loose indicators for called numbers are not utilized the present card may be employed, as shown. Similarly, when thin and highly flexible paper sheets are employed they should be backed with heavier cardboard or other suitable backing material. It will be noticed that the two holding slots of the present article tend to maintain the cards in a counterbalanced relationship, which is useful, especially because the holder can be made of light weight material and might otherwise be more subject to being tilted. In this respect the downward to the front inclination of the forward slot helps to bring the card to bear against a table top, when present, and further helps to stabilize the assembled structure.

The illustrated article is relatively flat so that it does not occupy any excessive amount of storage space. The presences of the projections in the slot walls and the counterbalancing effects previously mentioned help to give the article stability, despite its thinness and light weight. Storage of the invented articles may be improved (compacted) by having them fit together, or nest, at least partially, by inclining the sides and hollows thereof in conventional nesting design, and removing unnecessary wall portions where such can interfere with nesting. Normally, although such nesting is desirable, because of the comparatively low structure illustrated it will not be necessary, and accordingly it is not specifically illustrated herein although it is considered to be within the present invention. In some aspects of the invention the holders may be pressed flat for storage and then may be restored to desired shape for use by folding or interfitting of parts (as when some paperboard parts are incorporated in the structure) and sometimes may be returned to shape by means of the material's "memory". Similarly, the holders may be made to lie or pack essentially flat and may be expandable to shape (as by inflation), foldable and tapable to form, holdable by snap joints at corners, or assemblable with other known fastening means.

In playing a game of bingo on a plurality of different boards, using the present articles, one first selects the desired number of holders, joins them together longitudinally, using a plurality of lines of holders if that is desired, and inserts the cards, mounted sheets or other bingo board devices in place in both the substantially vertical and substantially horizontal holding means or slots. Preferably, the boards are slid together and at least some of them bridge adjoining holders. Various marking devices and implements may be stored in one or more of the recesses in the holders. If desired, such recesses may be omitted from some of the holders but it is preferred that they all include them, for reasons which were previously given. Typical bingo card holders of this invention, for example, those including such recesses, may be about 17 centimeters long, 3.2 cm. high and 7.6 cm. wide or deep, with the slots thereof being about 0.5 cm. wide, 1.9 cm. long (horizontal) and 2.5 cm. deep (vertical). In such devices the dovetail will often be about 1.6 cm. across and 0.6 cm. deep and the cavity or recess can be about 10 cm. long and 3.5 cm. in diameter. When the recess is omitted the vertical slot will usually not be as deep and the holder won't be as wide. For example, then these dimensions may be reduced to about 1.9 and 5.7 cm., respectively. However, the slot walls and the recess walls, when present, will usually be within 0.3 to 2 cm. of each other and/or of other holder walls at at least some locations, which aids in strengthening the article. In some cases it may be desirable to utilize a rubber pad or rubber feet at the base of the holder to minimize undesirable sliding thereof. When the game has been played it is a simple matter to remove or re-set the bingo boards or cards for a subsequent game. In some instances Velcro® fasteners may be used to hold markers to the boards by the characteristic hook and loop holding means thereof.

The invention has been described with respect to various illustrations and embodiments thereof but is not to be limited to these because it is evident that one of skill in the art, with the present specification and drawing before him, will be able to utilize substitutes and equivalents without departing from the invention.

What is claimed is:

1. A holder for a plurality of bingo cards to be played simultaneously by a single player which comprises a body having at least a pair of holding means, each of which is capable of supporting a bingo card, with such cards being holdable so that one is substantially horizontal and another is substantially vertical.

2. A bingo card holder according to claim 1 in which the holding means are walled slots and which includes means at ends thereof for joining to other such holders.

3. A bingo card holder according to claim 2 which includes a base portion for supporting the holder on a horizontal surface, and in which the slots are inclined from 0° to 30° from the horizontal and from 0° to 45° from the vertical, respectively.

4. A bingo card holder according to claim 3 wherein the slots are longitudinally oriented and include projections on the walls thereof adapted to hold bingo cards in place.

5. A bingo card holder according to claim 4 wherein the slots are oriented from 5° to 15° from the horizontal and from 5° to 30° from the vertical, respectively, with the lower portion of the substantially horizontal slot being nearer to the player and with the upper portion of the substantially vertical slot being farther away from the player.

6. A bingo card holder according to claim 5 which includes a longitudinally extending recessed wall in an upper surface thereof which forms a cavity suitable for holding bingo playing implements, including daubers and markers, the walls of which cavity aid in rigidifying the holder.

7. A bingo card holder according to claim 6 wherein the card holding slots are continuous with slots in other such holders when a plurality of holders is assembled together.

8. A bingo card holder according to claim 7 in which the material of construction is a thermoplastic polymer with an average wall thickness in the range of about 1 to 3 millimeters.

9. A bingo card holder according to claim 8 wherein the rear portion of the upper surface is substantially horizontal and the forward portion of such upper surface extends downwardly to the front and substantially parallels the forward card holding slot.

10. A bingo card holder according to claim 9 wherein the joining means at the ends of the holder are dovetail joint elements constructed for assembly of holders together by vertical relative movements thereof.

11. A bingo card holder according to claim 10 adapted to at least partially nest with other such holders to facilitate packing, shipping and storage of the holders.

12. A bingo card holder according to claim 11 wherein each slot is adapted to hold more than one bingo card.

* * * * *